United States Patent [19]

Betts et al.

[11] 4,250,722

[45] Feb. 17, 1981

[54] TAKE-UP MECHANISM

[75] Inventors: Max W. Betts; John Flavell, both of Coventry, England

[73] Assignee: Courtaulds Limited, London, England

[21] Appl. No.: 955,652

[22] Filed: Oct. 30, 1978

[30] Foreign Application Priority Data

Nov. 10, 1977 [GB] United Kingdom ..... 46797/77

[51] Int. Cl.[3] ..... D04B 15/44; D04B 27/12; D04B 27/14

[52] U.S. Cl. ..... 66/146; 242/147 R; 242/129.2

[58] Field of Search ..... 66/146, 125, 126 R, 66/64, 60; 242/147 R, 129.1, 129.2

[56] References Cited

U.S. PATENT DOCUMENTS

| | | | |
|---|---|---|---|
| 2,108,773 | 2/1938 | Lawson | 66/146 |
| 2,209,839 | 7/1940 | Long | 66/146 |
| 2,449,105 | 9/1948 | Bradley et al. | 66/146 |

FOREIGN PATENT DOCUMENTS

| | | | |
|---|---|---|---|
| 499374 | 11/1954 | Italy | 66/146 |
| 329991 | 5/1930 | United Kingdom | 66/146 X |
| 840618 | 7/1960 | United Kingdom | 66/146 X |
| 1442573 | 7/1976 | United Kingdom | 66/146 X |

OTHER PUBLICATIONS

Stroganov et al. "Tekhnol Legkoi Prom.", Investigation of the Process of Thread Compensation During Knitting on a Flat Machine, 1977, U.S.S.R., pp. 120–124.

*Primary Examiner*—Ronald Feldbaum
*Attorney, Agent, or Firm*—Davis, Hoxie, Faithfull & Hapgood

[57] ABSTRACT

A yarn take-up mechanism for a knitting machine, especially a flat V-bed knitting machine comprises a yarn take-up arm pivotally mounted at one end on a stanchion and urged by a spring to pivot so that its other end moves away from the stanchion. Said other end of the arm carries a movable yarn guide and the yarn path in the take-up mechanism is from a fixed yarn guide on the stanchion through the movable yarn guide and back to the other fixed guide on the stanchion, the fixed guides being close together and adjacent the location of the movable guide when it is in the position closest to the stanchion. The end of the take-up arm carrying the movable yarn guide is flexible whereas the remainder of the arm is stiff.

4 Claims, 5 Drawing Figures

TAKE-UP MECHANISM

Figure 1:
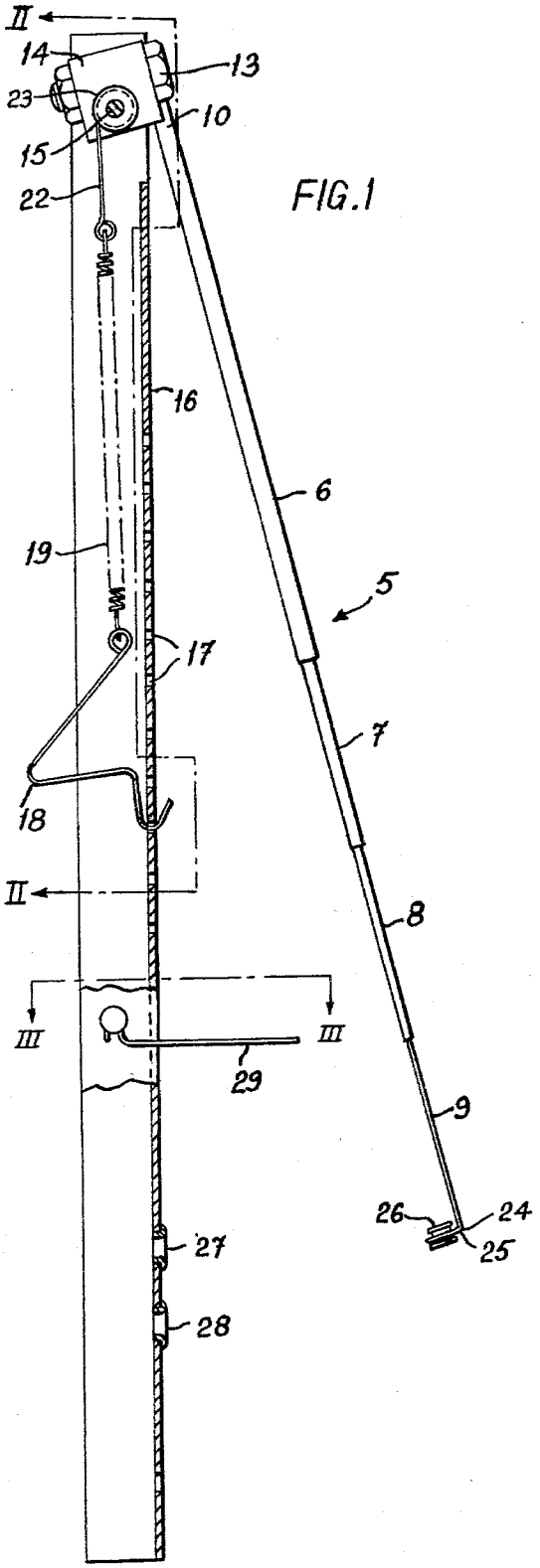

This invention is concerned with problems involved in the take-up of yarn during operation of a knitting machine.

In knitting machines in which yarn is supplied to a yarn carrier which reciprocates along at least one array of needles, a problem can arise if knitted courses differing substantially in length have to be formed without alteration in the stroke of the yarn carrier. If the yarn is supplied to the yarn carrier in a direction along the needle array from one end of the array then when the yarn carrier reverses its direction of movement at a location between the adjacent end of the last knitted course and the end of the array of needles from which the yarn is supplied, no difficulty arises no matter where the end of the knitted course is located since the yarn carrier merely guides the yarn direct to the knitting. However, when the yarn carrier moves into the region in which it is more remote than the knitting on the needles from the end of the array of needles from which the yarn is supplied, problems arising from inadequate take-up of excess yarn removed from the yarn supply may occur. The yarn then extends to the yarn carrier and substantially retraces part of its path, back to the knitting. Thus, as the yarn carrier moves further away from the adjacent end of the last knitted course a length of yarn equal to twice the distance moved by the carrier must be drawn from the yarn supply and the same quantity of yarn must be taken up when the yarn carrier reverses its direction of movement. If the knitted fabric narrows substantially whilst the amplitude of the yarn carrier movement remains the same, the amount of yarn to be taken up can be considerable and the speed of take-up required can be comparatively high because of the speed of movement of the yarn carrier, typically 1 meter per second.

The situation can cause serious difficulties in the production of knitted fabric of varying width (for example shaped garment panels) in that previous solutions for achieving sufficient take-up capacity and a sufficiently rapid take-up response have relied largely on increasing the spring forces acting on pivoted take-up arms whilst at the same time lengthening the arms. The increased spring forces have had the effect of raising the tension in the yarn supplied so that unacceptably high tensions have been reached and the rate of yarn take-up achieved has sometimes not been high enough to allow for a normal speed of movement of the yarn carrier at the reversal of direction.

One aim of the present invention is to provide an improved yarn take-up arm for a yarn take-up mechanism for a knitting machine which can afford a comparatively large take-up capacity. The improved take-up arm of the invention can also be adapted to give a rapid take-up response under the action of comparatively low forces to allow rapid take-up under conditions of low yarn tension. Another aim of the invention is to provide a yarn take-up mechanism incorporating this improved yarn take-up arm.

According to one aspect of the invention, in a yarn take-up arm for a yarn take-up mechanism for a knitting machine, there is provided a structure wherein an end part of said arm at the free end thereof is made of flexible material to absorb transient changes of tension in the yarn, the remainder of the arm is stiff, and a yarn guide is supported on said flexible end part of the arm.

According to another aspect of the invention, in a yarn take-up mechanism for a knitting machine including a yarn take-up arm mounted for pivotal movement about an axis extending transversely of the length direction of the arm, spring means to urge said arm to rotational movement in one direction round its pivot, a yarn guide at a location on the arm remote from the pivot and fixed yarn guides to lead yarn to and from said yarn guide on the take-up arm, there is provided the improvement comprising a structure wherein an end part of said arm is flexible to absorb transient changes of tension in the yarn, the remainder of the arm is stiff, and said yarn guide on the arm is supported on said flexible end part.

In one embodiment of the yarn take-up mechanism in accordance with the invention, the take-up arm is mounted for pivotal movement on a stanchion, the axis of pivotal movement of said arm extends transversely of the length direction of the stanchion and said arm is urged by said spring means to rotate so as to move the yarn guide thereon away from the stanchion. Two closely adjacent yarn guides are located on the stanchion at a position adjacent said yarn guide on the take-up arm when said arm is rotated on its pivot to lie close to the stanchion along the whole of its length, whereby yarn can be guided to follow a path through one of said yarn guides on the stancion, through said yarn guide on the take-up arm and through said other yarn guide on the stanchion.

According to yet another aspect of the invention, a yarn take-up system for a knitting machine comprises a movable yarn guide, two fixed yarn guides located adjacent one another in a plane, structure guiding said movable yarn guide in its movement along a path which meets said plane in the region of said two fixed guides, the yarn path in the take-up system extending from one of said two fixed guides through said movable guide and back through the other of said two fixed guides.

Figure 2:
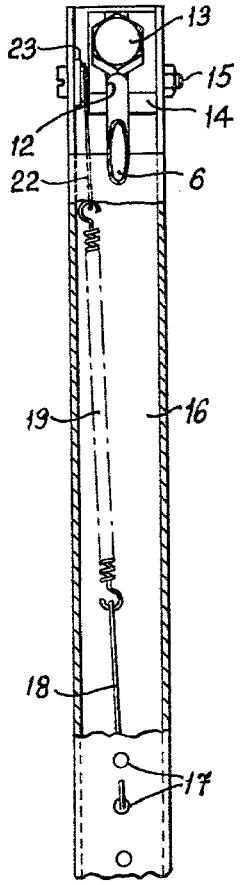
Figure 3:
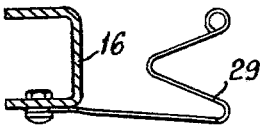
Figure 4:
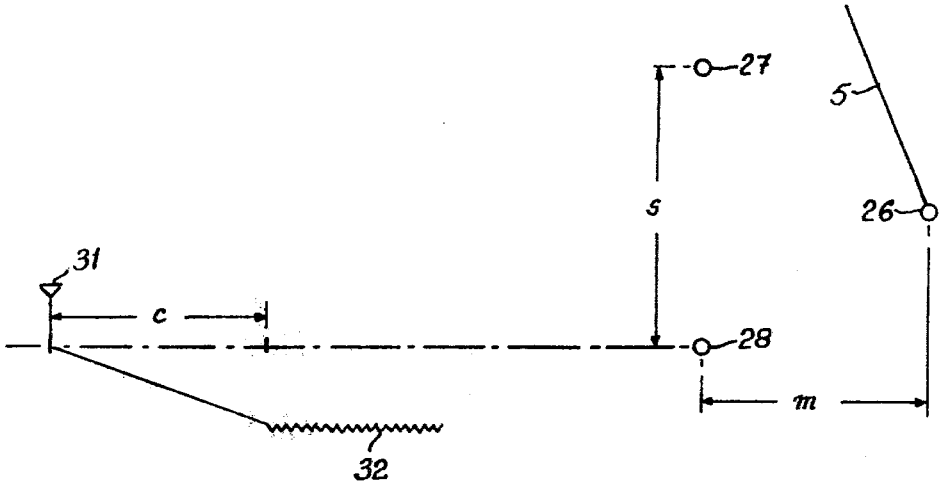
Figure 5:
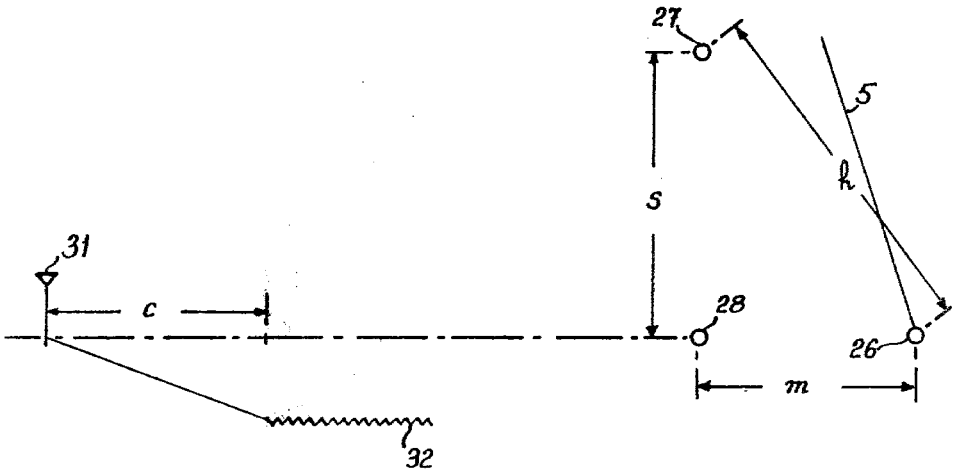

The invention will not be further described, by way of example, with reference to the accompanying drawings, in which FIG. 1 is a partly sectioned side view of a yarn take-up mechanism according to the invention, FIG. 2 is a sectional view, on the line II—II of FIG. 1, showing part of the take-up mechanism of that Figure, FIG. 3 is a sectional plan taken on the line III—III of FIG. 1, and FIGS. 4 and 5 are diagrams of two possible arrangements of yarn guides in mechanisms according to the invention.

The yarn take-up mechanism shown in the drawings comprises a take-up arm 5 made up of four parts 6,7,8 and 9. At the upper end 10 of the arm in FIG. 1, the part 6 of the arm is clamped in a groove 12 in a bracket 14 by a bolt 13 through which the arm part 6 passes. The bracket 14 is pivoted at 15 on a stanchion 16. The stanchion 16 comprises a channel section member and the base of the channel has a series of apertures 17 for reception of a hook 18 attached to a coil spring 19. The coil spring 19 is attached to a multi-wire strand 22 wrapped round a capstan 23 secured to the bracket 14 and lying on the axis about which the bracket is pivoted. The arrangement is such that the spring 19 urges the arm 5 to rotate in an anti-clockwise direction in FIG. 1 around its pivot 15.

The parts 6, 7 and 8 of the take-up arm 5 are constituted respectively by a piece of 10 gauge tube (i.e. an inside diameter (I.D.) of 0.100 inch and an outside diameter (O.D.) of 0.129 inch), a piece of 13 gauge tube (i.e. an I.D. of 0.069 inch and an O.D. of 0.092 inch) and a piece of 17 gauge tube (i.e. an I.D. of 0.042 inch and an O.D. of 0.058 inch). The part 9 of the arm 5 is constituted by a piece of 20 SWG piano wire (i.e. 0.036 inch diameter). The length of the part 6 from the pivot axis of the bracket 14 to the lower end of the part 6 is 150 mm. The part 7 is a push fit within the part 6 and is soldered to it. The projecting length of the part 7 is 50 mm. Similarly, the part 8 is a soldered push fit within the part 7 and the projecting length of the part 8 is 50 mm. Finally, the part 9 is a soldered push fit within the part 8 and the projecting length of the part 9 to the point 24 is 50 mm.

The free end portion 25 of the part 9 is bent into a curve to support a ceramic eyelet 26 constituting a yarn guide.

Because of the nature of the structure of the take-up arm 5, the parts 6, 7, 8 and 9 of the arm are of successively decreasing stiffness and increasingly flexible, but such that even the part 8 offers considerable resistance to bending whereas the part 9 made of piano wire is relatively easily bent in a resilient manner. Instead of the composite structure described, the take-up arm 5 may be made of tapered tubing with a wire end.

The take-up mechanism shown in the drawings is suitable for fitting to a V-flat knitting machine and has two ceramic eyelet yarn guides 27 and 28 mounted in apertures in the base of the channel section stanchion 16, and having their axes parallel. In use, the take-up mechanism is secured on a V-flat knitting machine near one end of the needle beds in such a way that the channel section stanchion 16 is upright with its open channel facing in the direction of the needle beds. Yarn from a supply, which may be located above and to one side of the needle beds, is led from the left in FIG. 1 through the eyelet 27, passes through the eyelet 26 at the end of the arm 5, then through the eyelet 28 and thence to a yarn feeder above the needle beds of the machine.

Because the arm 5 is urged in an anti-clockwise direction in FIG. 1, any slackness in the yarn (up to a defined limit) is taken up by movement of the eyelet 26 away from the eyelets 27 and 28 in FIG. 1 with consequent increase in the length of the yarn path. Because of the length of the arm 5 from the pivot 15 to the eyelet 26 (300 mm) the take-up mechanism is able to accommodate considerable variations in yarn path whilst maintaining adequate tension in the yarn.

The eyelets 27 and 28 are closely adjacent one another and the arcuate path of the eyelet 26 as the arm 5 pivots carries the eyelet 26 directly away from the eyelets 27 and 28. Movement of the arm 5 towards the eyelets 27 and 28 is limited by a stop member 29 secured to the stanchion 16 and seen in plan in FIG. 3. The stop member 29 is formed into a V shape and arranged so that the arm 5 is received in the V, the apex of which limits the approach of the arm to the stanchion 16. Initial movement of the arm 5 from its closest position of approach to the stanchion 16 carries the eyelet 26 along a path substantially at right angles to a plane containing the eyelets 27 and 28 (i.e. at right angles to their axes), approximately parallel to the axes of those eyelets and lying between those axes.

Since the eyelets 27 and 28 are closely adjacent one another and the initial movement of the eyelet 26 is directly away from eyelets 27 and 28 from a position lying between their axes, the geometry of the arrangement is such as to produce a substantial increase in yarn path for a given amplitude of movement on the part of the eyelet 26. Or, viewing the arrangement from another point of view, a given movement of the eyelet 26 under the urging of the spring 19 enables the take-up mechanism to absorb a substantial length of yarn. An important factor in achieving this result is to have the distance between eyelets 27 and 28 as short as practicable.

This can be seen from FIG. 4 where c represents the movement of a yarn carrier 31 resulting in a lateral movement m on the part of the eyelet 26.

If the presence of the stop member 29 is ignored, the initial yarn path from eyelet 27 to eyelet 28 is s and the final yarn path (via eyelet 26) must be s+2c, since the yarn released when the carrier moves back towards the knitted fabric 32 has a length 2c.

$$\text{Thus, } m^2 + \left(\frac{s}{2}\right)^2 = \left(c + \frac{s}{2}\right)^2$$

$$\text{or } m = \sqrt{(c^2 + cs)}$$

and to obtain small values of m for a given value of c, s must be as small as possible.

However, the take-up arm movement can be made less critically dependent on the spacing between the eyelets 27 and 28 by arranging the eyelet 26 on or near the axis of one of the eyelets. Thus, in FIG. 5, $$(h + m) - s = \text{additional yarn path in take-up system for carrier movement } c = 2c$$

$$\therefore h = s + 2c - m$$

$$\text{But } h^2 = m^2 + s^2$$

$$\therefore m = 2c\left(\frac{s + c}{s + 2c}\right)$$

and this expression for m shows it to be less dependent on the value of s and to have smaller values for a given value of c, that is with this arrangement a smaller take-up arm movement is required to compensate for a given carrier movement.

Further investigation of the arrangement of FIG. 5 shows that the rate of change of m is greater at greater distances of the eyelet 26 from the eyelet 28. That is, if a stop is inserted in the system to limit the closeness of approach of the eyelet 26 to compensate for a given carrier movement c, m is smaller than if eyelet 26 were allowed to approach eyelet 28 so as to be immediately adjacent thereto.

Thus the criteria for obtaining the most extensive take-up arm are to have eyelets 27 and 28 as close together as practicable, to arrange eyelet 26 approximately level with one of the other eyelets (almost always the lower one) and to have a stop preventing close approach of the eyelet 26 to the said other eyelet. In fulfilling these criteria one must have regard to the angles of wrap of the yarn about the eyelets in the chosen configuration of the yarn path (the angles of wrap must not be too great so as to increase the frictional force on the yarn inordinately). One must also not arrange the stop so far from the eyelet 28 as to reduce the total movement of the take-up arm to too great a degree.

In order to reduce transient tensions in the yarn supplied to the carrier, it is desirable to operate with a low spring tension acting on the take-up arm but this must be consistent with a rapid movement of the take-up arm when the take-up mechanism is required to take in a considerable quantity of yarn quickly on reversal of the carrier in conditions such as shown in FIGS. 4 and 5. The present investigators have demonstrated the importance, previously unappreciated, of reducing the moment of inertia of the take-up arm to produce a rapid natural frequency of response in the arm. At the same time, mere reduction in the weight at the free end of the arm and use of thinner, more flexible wire as the material of the arm were found to have a relatively insignificant effect on take-up performances because the improvement in frequency response by weight reduction at that point were counteracted by decrease in stiffness as the thickness of the wire of the arm was reduced.

In fact, the frequency response (f) is dependent on the length and stiffness in the following ways:

$$f \alpha \frac{1}{\text{stiffness}} \text{ and } f \alpha \sqrt{\text{length}^3}$$

These relationships in themselves lead one to look for a minimum length looper arm of maximum stiffness but these criteria must be tempered by the need to have a long arm to secure sufficient degree of movement of the yarn guide at the free end of the arm, by considerations of the overall weight of the arm and by the need for some flexibility to limit momentary tension build up in the yarn.

The best results are obtained by employing as a take-up arm a tubular member of decreasing diameter towards the free end of the arm and culminating in a relatively short length of flexible wire to absorb peak tensions in the yarn. Such an arrangement produces a rapid frequency of response in the arm coupled with the necessary degree of flexibility to reduce peak tensions.

What is claimed:

1. In a knitting machine having a yarn take-up arm mounted on a support member for pivotal movement about an axis extending transversely of the length direction of the arm, spring means to urge said arm to rotational movement in one direction around its pivot, a yarn guide at a location on the arm remote from the pivot and fixed yarn guides on said support member to lead yarn to and from said yarn guide on the take-up arm, the improvement comprising a structure:

(a) wherein said arm comprises:

(i) a light, stiff, tubular part extending from said pivot and constituting the major portion of said arm, (ii) a normally straight, flexible end part constituting a minor portion of said arm and serving to absorb transient tensions in the yarn, said flexible end part being rigidly secured to said tubular part, and (iii) said yarn guide being fixed on said straight, flexible end part close to the axis thereof;

(b) wherein said fixed yarn guides include two yarn guides located side-by-side on said support member and close to one another;

(c) wherein said pivoted take-up arm is positioned to guide said movable yarn guide along a path the extension of which passes in the region of said fixed yarn guides and the distance from said pivot to said movable yarn guide is at least equal to the distance from said pivot to the proximal one of said two yarn guides to said pivot but not greater than the distance from said pivot to the distal one of said two yarn guides; and (d) wherein said mechanism also includes a stop fixed on said support member at a distance from said pivot which is less than or equal to the distance from said pivot to the proximal one of said two yarn guides, said stop restricting movement of said take-up arm towards said fixed yarn guides and defining a base position of said movable yarn guide at a distance from a line joining said fixed yarn guides greater than the distance between said fixed yarn guides, said stop being arranged to act near the junction of said major tubular part of said take-up arm and said flexible end part thereof, whereby said end part can flex and take-up transient changes in yarn tension when said arm is pulled into its base position by yarn threaded through one of said fixed yarn guides, through said movable yarn guide, and through the other of said fixed yarn guides.

2. A yarn take-up mechanism as claimed in claim 1 wherein said movable yarn guide is fixed on said straight end part of the take-up arm by deformation of the extreme end portion of the material of the end part about the yarn guide.

3. In a knitting machine having a yarn take-up mechanism including a yarn take-up arm mounted on a support member for pivotal movement about an axis extending transversely of the length direction of the arm, a spring means to urge said arm to rotational movement in one direction around its pivot, a yarn guide at a location on the arm remote from the pivot and fixed yarn guides on said support member to lead yarn to and from said yarn guide on the take-up arm, the improvement comprising a structure:

(a) wherein said arm comprises:

(i) a light, stiff, multi-sectional tubular part comprising sections of different diameters extending from said pivot and constituting the major portion of said arm, the largest diameter tubular section of which is mounted on said support member and comprises at least half the length of said arm, there being at least two further tubular sections of said part such that any section is of smaller diameter than any other section closer to said pivot, (ii) a normally straight, flexible end part constituting a minor portion of said arm and serving to absorb transient tensions in the yarn, said flexible end part being rigidly secured to said tubular part, and (iii) said yarn guide being fixed on said straight, flexible end part close to the axis thereof;

(b) wherein said fixed yarn guides include two yarn guides located side-by-side on said support member and close to one another;

(c) wherein said pivoted take-up arm is positioned to guide said movable yarn guide along a path the extension of which passes in the region of said fixed yarn guides; and (d) wherein said mechanism also includes a stop fixed on said support member, said stop preventing close approach of said take-up arm towards said fixed yarn guides and defining a base portion of said movable yarn guide at a distance from said fixed yarn guides, said stop being arranged to act on said major tubular part of said take-up arm, whereby said end part can flex and take-up transient changes in yarn tension when said arm is pulled into its base position by yarn threaded through one of said fixed yarn guides, through said movable yarn guide and through the other of said fixed yarn guides.

4. A yarn take-up mechanism as claimed in claim 1 or claim 3, wherein said spring means is a coil spring attached to a strand wrapped around a capstan rotatably mounted on said support member, said arm being secured to said capstan.

* * * * *

UNITED STATES PATENT AND TRADEMARK OFFICE

CERTIFICATE OF CORRECTION

PATENT NO. : 4,250,722

DATED : February 17, 1981

INVENTOR(S) : Max W. Betts, John Flavell

It is certified that error appears in the above—identified patent and that said Letters Patent is hereby corrected as shown below:

Col. 2, line 39 Change "not" to - now -
Col. 6, line 63 Change "portion" to - position -

Signed and Sealed this

*Twenty-first* Day of *July 1981*

[SEAL]

*Attest:*

GERALD J. MOSSINGHOFF

*Attesting Officer*

*Commissioner of Patents and Trademarks*